US005791167A

United States Patent [19]

Wyatt et al.

[11] Patent Number: 5,791,167

[45] Date of Patent: Aug. 11, 1998

[54] AUTOMATIC WASHER AND A WASH PLATE CLOTHES DEFLECTOR THEREFOR

[75] Inventors: Vicki Lyn Wyatt, Watervliet; Dale E. Mueller, Benton Harbor; Gerald L. Kretchman, St. Joseph; James W. Titus, Coloma, all of Mich.

[73] Assignee: Whirlpool Corporation, Benton Harbor, Mich.

[21] Appl. No.: 857,955

[22] Filed: May 16, 1997

Related U.S. Application Data

[60] Provisional application No. 60/018,197, May 13, 1996.

[51] Int. Cl.[6] ..... D06F 17/10

[52] U.S. Cl. ..... 68/134; 68/131

[58] Field of Search ..... 68/53, 131, 133, 68/134

[56] References Cited

U.S. PATENT DOCUMENTS

| | | | |
|---|---|---|---|
| 1,288,085 | 12/1918 | McGinniss | 277/484 |
| 2,041,639 | 5/1936 | Georgilas | 68/133 |
| 2,145,453 | 1/1939 | Miller | 68/28 |
| 2,311,557 | 2/1943 | Mason | 277/484 |
| 2,802,356 | 8/1957 | Kirby | 68/23.3 |
| 2,902,851 | 9/1959 | Fields | 68/131 |
| 4,079,949 | 3/1978 | McCormick | 277/463 |
| 5,172,921 | 12/1992 | Stenlund | 277/237 R |
| 5,507,053 | 4/1996 | Mueller et al. | 68/131 X |

*Primary Examiner*—Philip R. Coe

*Attorney, Agent, or Firm*—Thomas A. Schwyn; Robert O. Rice; Thomas J. Roth

[57] ABSTRACT

A washplate deflector for an automatic washer having a wash basket and a moveable washplate positioned within the basket. The deflector is mounted to the periphery of the washplate and abuts the wash basket, preventing clothing disposed in the wash basket from being caught between the washplate and the wash basket.

39 Claims, 8 Drawing Sheets

AUTOMATIC WASHER AND A WASH PLATE CLOTHES DEFLECTOR THEREFOR

BACKGROUND OF THE INVENTION

This application claims the benefit of U.S. Provisional Application No. S/N 60/018197 filed May 23, 1996.

1. Field of the Invention

The present invention relates generally to clothes washing machines and more specifically to a wash plate clothes deflector for an automatic washer.

2. Description of the Related Art

It is an ongoing challenge in the field of automatic clothes washers to use less energy and water while providing comparable or superior wash results than current automatic washers. However, all such attempts are subject to the optimization of the basic equation for wash performance, which is defined by a balance between the chemical (the detergent efficiency and water quality), thermal (energy to heat water), and mechanical (application of fluid flow through, fluid flow over, fluid impact or fabric flexing) energy inputs into the system. Experience has shown that any reduction of one or more of these factors requires a increase in one or more of the other factors to produce comparable levels of wash performance.

One common type of automatic washing machine is a vertical axis washer incorporating a submersion wash process. Typically, the vertical axis washer has a vertically oriented imperforate tub in which is mounted a perforated wash basket for receiving clothing. Typically, the tub is filled with a wash liquid, a combination of detergent and water (to saturate and fully submerse the clothing in the wash liquid). One disadvantage of this system is that a relatively large amount of water, as much as 46 gallons, must be used to suitably wash a singled load of clothing. The large water requirement is generally attributable to the oscillating agitator, which to properly apply mechanical energy to the clothing without causing damage requires that all the clothes must be substantially submerged in the wash liquid.

To reduce the amount of wash liquid used in automatic washers, alternate washing apparatuses and processes have been contemplated for providing mechanical energy to the wash load without requiring complete submersion of the fabric items. An example of such an automatic washer is illustrated in U.S. Pat. No. 5,271,251, issued to Kovich et al, which discloses an automatic washer having a basket with a ramp and a baffle extending inwardly into the wash basket to provide mechanical energy into the fabric.

U.S. Pat. No. 2,802,356 to Kirby, discloses a vertical axis washer without an agitator, but the wash basket is rotated in a wobbly motion within the tub so that during the wash cycle, the basket is filled with wash liquid and is given a wobbling motion that agitates and distributes the clothes to thoroughly wash them.

U.S. Pat. No. 2,145,453 to Miller discloses a vertical axis washing machine having a tub with a plate-like agitator, which moves in a gyratory motion with respect to the tub to agitate the clothing. In one embodiment, a gap is required between the edge of the agitator in the tub. In another embodiment, top of the tub is closed by a lid so that the clothes are compressed between the lid and the agitator to input mechanical energy to the clothing. A squeegee is mounted about the rim of the agitator to engage the tub and prevent the compressed material from becoming caught between the agitator and the side of the tub.

U.S. Pat. No. 2,902,851 also discloses a wobble-type agitator, which is sealed with respect to a tub by a flexible membrane interconnected between the agitator and the tub.

SUMMARY OF THE INVENTION

The invention is an automatic washer with a wash plate deflector for sealing the wash plate against a wash basket. Generally, the automatic washer comprises a wash basket which is defined by a perimeter wall with the wash plate disposed adjacent the wash basket. A deflector is provided on the wash plate in such a manner so that it abuts or contacts the perimeter wall to seal the wash plate with respect to the wash basket. The deflector comprises a biasing portion and a low friction portion. The biasing portions tends to bias the deflector into abutting relationship with the wash basket and the low friction portion tends to decrease the friction between the deflector and the wash basket permitting the wash plate to move with relative ease with respect to the wash basket.

Preferably, the deflector further comprises an elastic layer as the biasing portion and a low friction layer as the low friction portion. The two layers can be separate or formed as a composite. Also, the low friction layer can extend beyond a peripheral edge of the elastic layer to prevent the elastic layer from directly abutting the wash basket and have several notches along its perimeter to prevent puckering and also allow for sand and small particulates to pass between the deflector and basket wall. The elastic layer can be made from an elastomer selected from the group of santoprene, EPDM, or rubber. The low friction layer can be made from polypropylene or any other suitable material. Further, the deflector can be integrally formed with the wash plate or be a separate piece mounted to the wash plate.

In a preferred embodiment, the clothes deflector is dual extruded with the elastic layer comprising santoprene and the friction layer comprising polypropylene. The friction layer having multiple substantially annular ribs that create channels between the friction layer and the wash basket. Abrasive particles in the wash liquid are washed away through the channels to reduce their abrading effect on the friction layer.

DESCRIPTION OF THE PREFERRED EMBODIMENT

Figure 1:
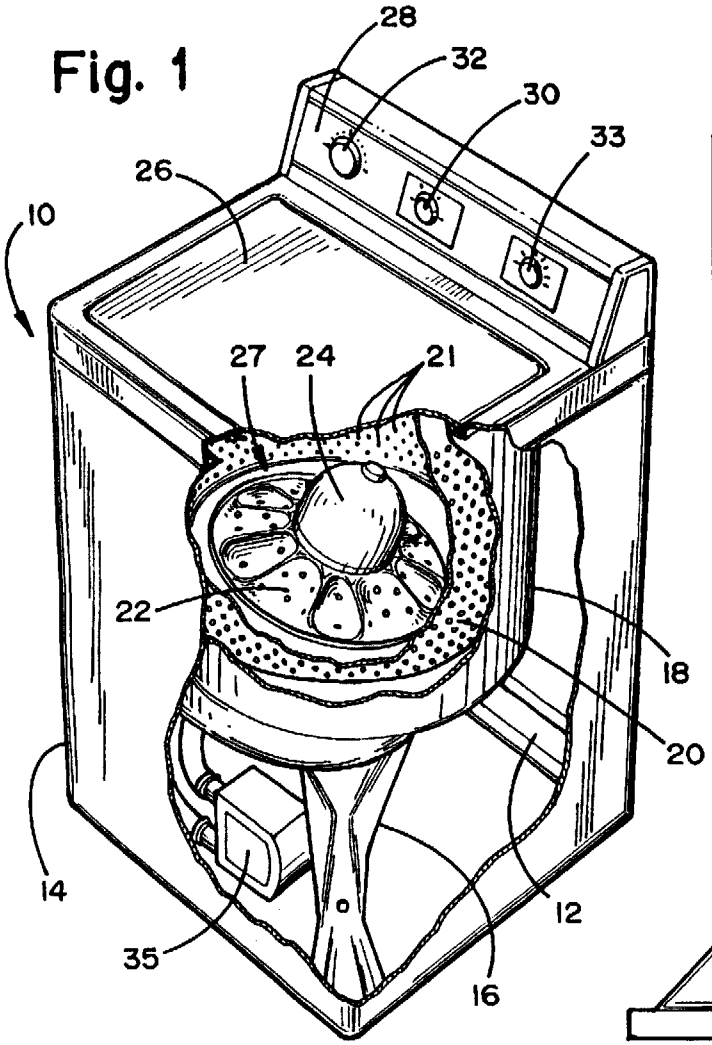
FIG. 1 is a perspective view of an automatic washer, partially cut away, to illustrate various interior components including a first embodiment of a wash plate clothes deflector according to the invention.
Figure 3:
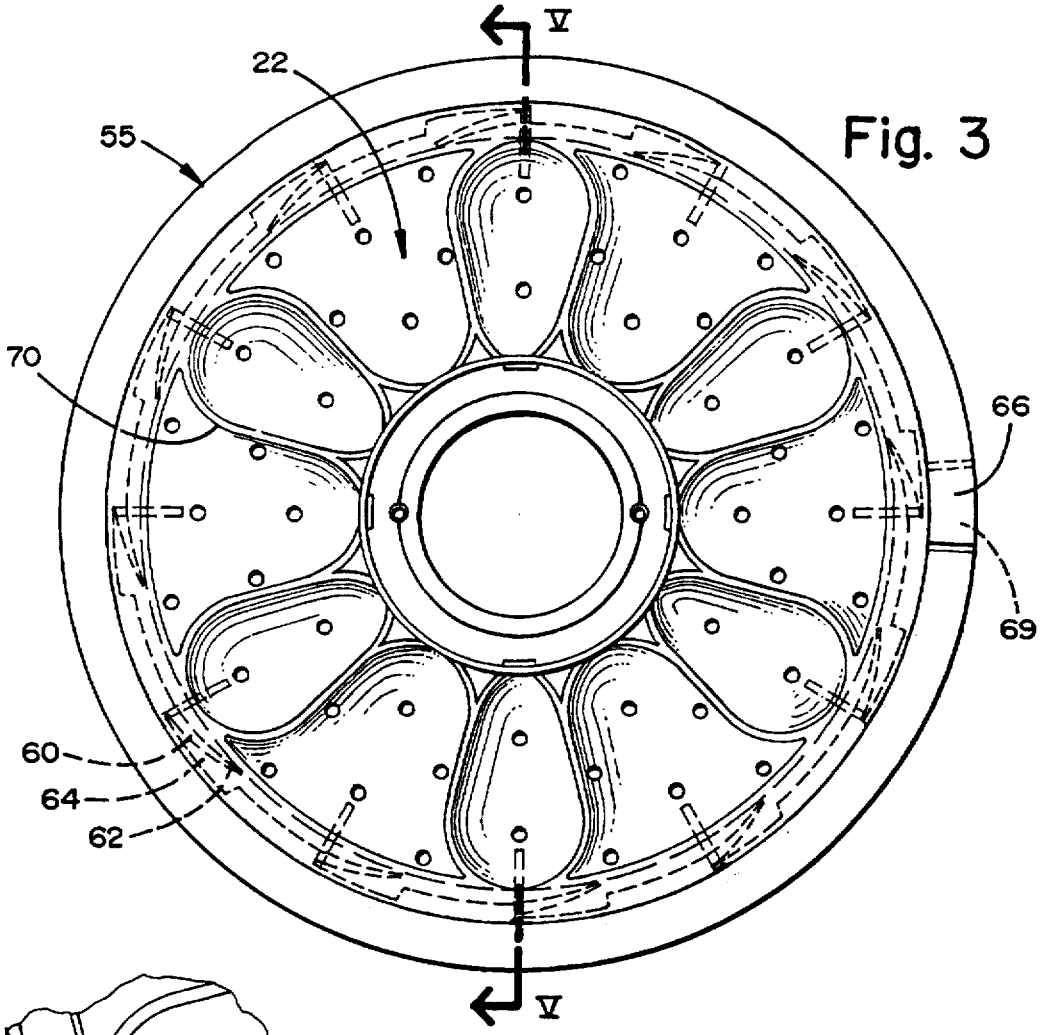
FIG. 3 is a plan view of the wash plate clothes deflector of FIG. 1.
Figure 4:
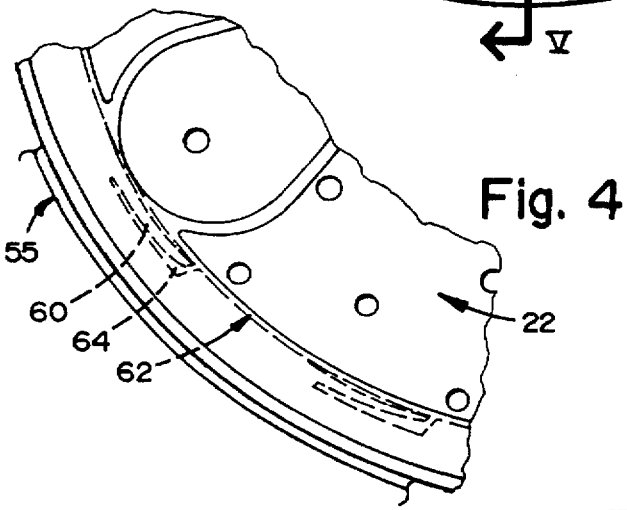
FIG. 4 is a partial enlarged view of the wash plate of FIG. 3.
Figure 5:
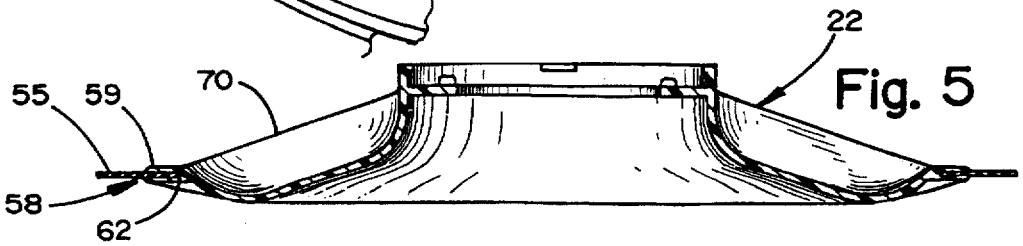
FIG. 5 is a cross-sectional view of the wash plate of FIG. 3 taken along line 5—5.
Figure 6:
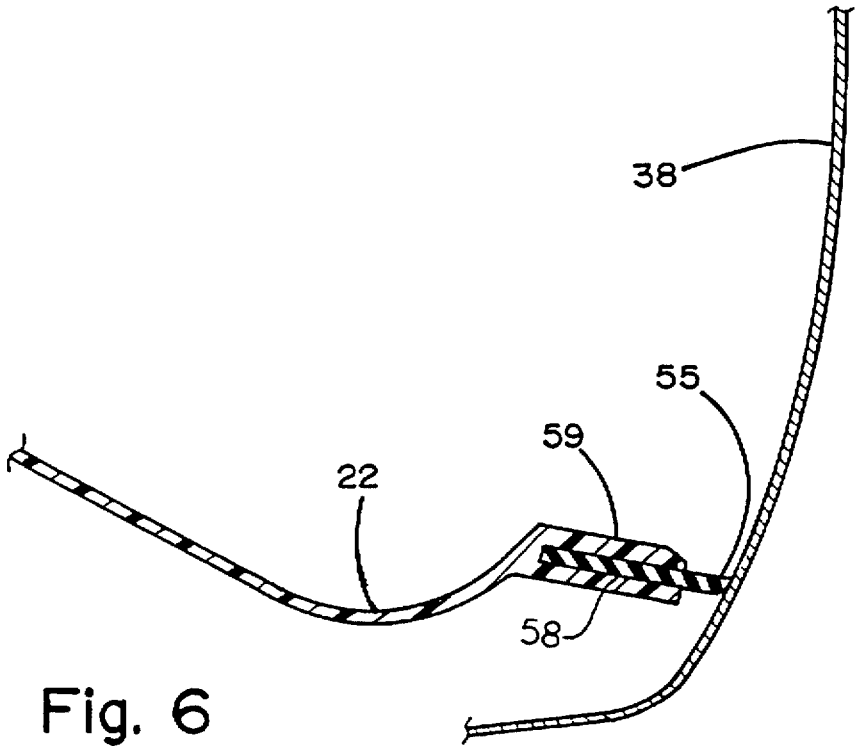
FIG. 6 is an enlarged sectional view of the wash plate and wash basket of FIG. 2, illustrating the relationship between the wash plate, wash plate clothes deflector and wash basket.

FIG. 1 illustrates an automatic washing machine 10 of the type having a pre-settable sequential control means for operating the washer through a pre-selected program of automatic washing, rinsing and de-watering operations for cleaning clothing. The washer comprises a frame 12, supporting a cabinet 14 having a lid 26, which in the usual manner provides access to the interior of the cabinet 14. The washer 10 also has a console 28, which includes a timer dial 30, temperature selector 32 and a cycle selector 33, all of which permit the user to control the various cycles and operations of the automatic washer 10.

Figure 2:
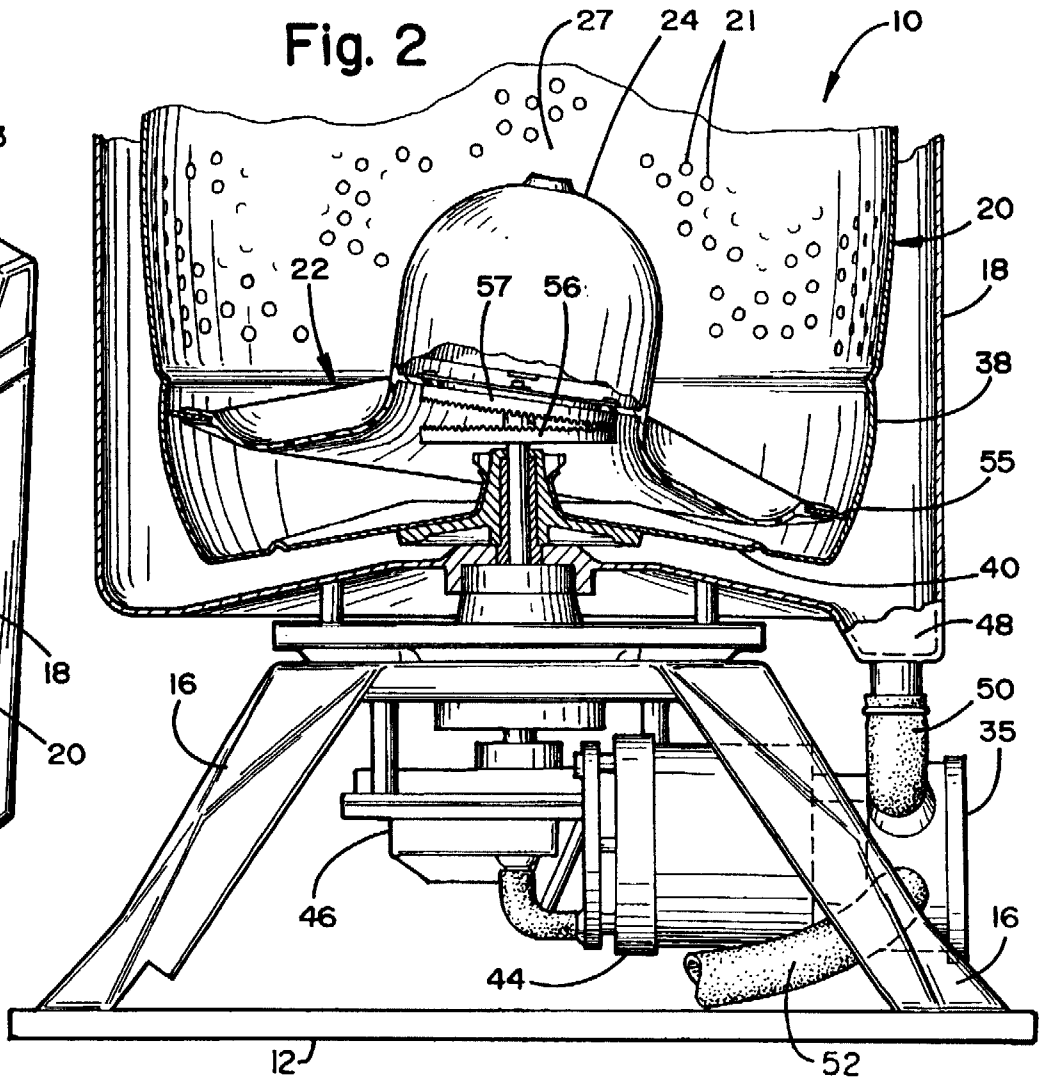
FIG. 2 is a side sectional view of the washer of FIG. 1 illustrating the first embodiment of the wash plate clothes deflector in greater detail.

Referring specifically to FIG. 2 and generally to FIG. 1, the internal structure of the automatic washer 10 is shown in greater detail. An imperforate wash tub 18 is supported within the cabinet 14 by multiple struts 16 extending from the frame 12. A sump 48 is formed at one end of the wash tub to permit the collection and draining of wash liquid. A wash basket 20 having a perforated portion with a plurality of perforations 21 and a non-perforated, spherical-shaped portion 38 is positioned within the wash tub 18. The interior of the wash basket 20 defines a treatment zone 27 in which the clothes are positioned for subsequent washing. A wash plate 22 having a peripheral wash plate clothes deflector 55 is positioned within the wash basket near its closed bottom and is driven to impart mechanical energy to clothing received within the treatment zone 27.

The wash plate 22 is driven by a motor 44 via a transmission 46, which is mounted to the base plate supported by the struts 16. A drain pump 35 is mounted to the motor 44 and is fluidly connected to the sump 48 by hose 50 to drain the liquid in the sump 48. The transmission 46 includes a drive shaft 47, which extends into the wash basket 20 and on which is mounted an upper gear 57 connected to the upper plate 22. A fixed complementary lower gear 56 is enmeshed with the upper gear 57 by the transmission 46, and initiates a corresponding rotation in the wash plate 22. The upper gear 57 is oriented at an acute angle with respect to the lower gear 56 so that the wash plate 22 is not only rotated about the axis of rotation of the drive shaft, but the wash plate 22 is also wobbled, or moved, vertically up and down during the rotation. The combined motion of the rotation and the wobbling results in a nutation motion of the wash plate 22.

Throughout this application, the terms wobble and nutate are used to describe the motion of the wash plate 22. A clear definition of these terms is beneficial to a full understanding of the invention. The term "wobble" or "wobbling" refers to gyratory motion described above in which the high point of the wash plate periphery gyrates precessionally about the central axis of a drive shaft. Wash plate "wobble" or "wobbling" may, but does not necessarily include wash plate rotation. In contrast, the term "nutate" or "nutation" more narrowly refers to the motion of gyratory oscillation and includes wash plate rotation. In this definition, nutation can be seen as a subset of the motion of wobbling.

FIGS. 3 through 6 illustrate a first embodiment of the wash plate 22 and the wash plate clothes deflector 55 in greater detail. The wash plate 22 further comprises a peripheral lip 59, which defines a notch groove 58 whose depth is limited by an inner wall 62. The clothes deflector 55 is press-fit or friction-fit within the notch groove 58. Although the clothes deflector 55 can be manufactured as single piece, it is preferred that the clothes deflector 55 be manufactured in at least two pieces. A single piece clothes deflector has the disadvantages of creating greater waste material during manufacturing and is more difficult to press-fit within the groove in that the clothes deflector must be stretched over the wash plate 22. The multipiece clothes deflector reduces the amount of discarded waste material and eliminates the need to stretch the clothes deflector over the wash plate 22 to increase the ease of assembly.

The clothes deflector 55 is preferably generally stiff, but still has some resiliency to insure that the clothes deflector 55 is elastically biased against the wash basket 20. The clothes deflector 55 is formed with a plurality of finger-like spring members 60 and their associated recesses 64 positioned along the inner edge of the clothes deflector 55. When the clothes deflector 55 is mounted within the notched groove 58 of the wash plate 22, the spring member 60 biases the clothes deflector 55 outwardly with respect to the wash plate 22 to insure that the clothes deflector 55 abuts the wash basket 20. The spring force of the spring member 60 and the resiliency of the material forming the clothes deflector 55 work in combination to insure the clothes deflector 55 abuts the wash basket 20 to form the necessary seal and prevent clothes stored within the treatment zone 27 from being caught between the nutating wash plate 22 in the wash basket 20. It should be noted that it is within the scope of the invention for the clothes deflector 55 to be made of a substantially non-resilient material, but having the spring member 60 solely insure the contact between the clothes deflector 55 and the wash basket 20. In a similar manner, it is also within the scope of the invention for the clothes deflector 55 to be formed without the spring member 60 and the resiliency or elasticity of the clothes deflector solely insures the contact of the clothes deflector 55 with the wash basket 20.

Figure 7:
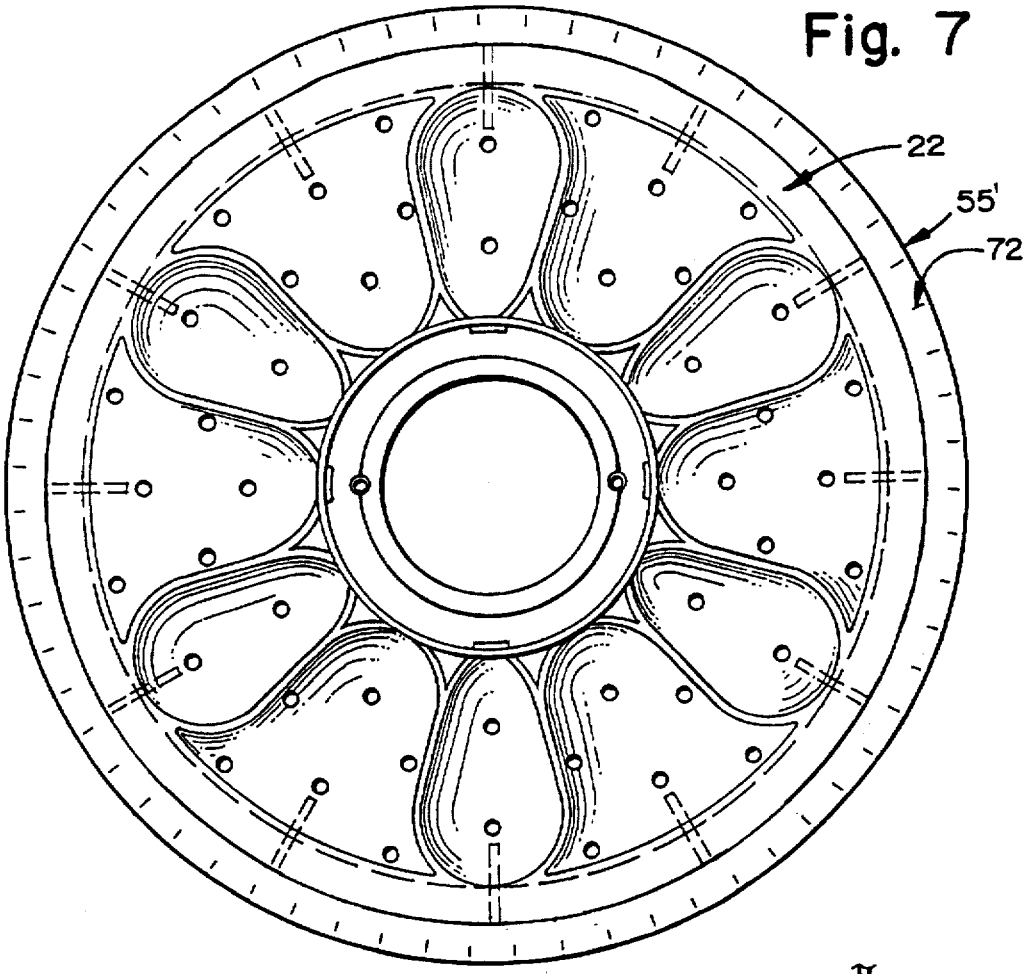
FIG. 7 is a plan view of the wash plate incorporating a second embodiment of the wash plate clothes deflector according to the invention.
Figure 8:
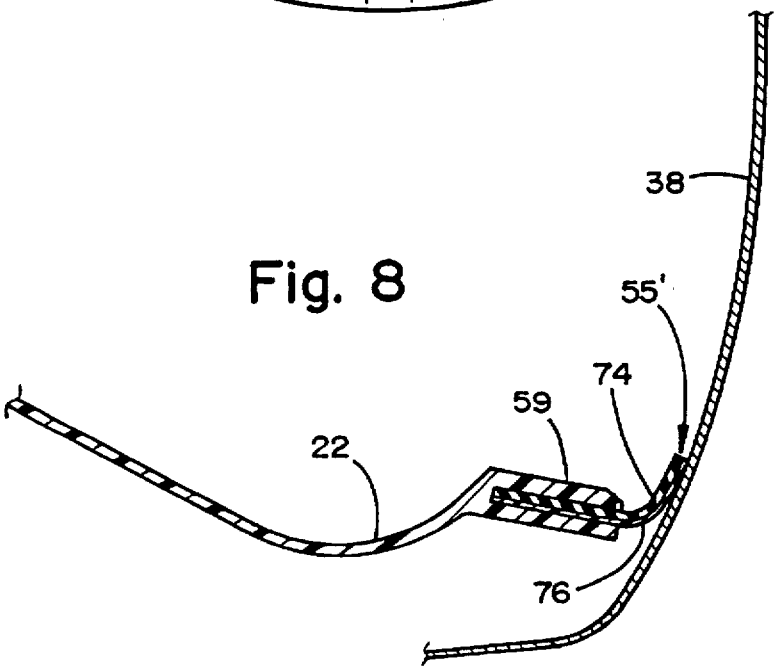
FIG. 8 is a sectional view similar to FIG. 6, but illustrating the relationship between the wash plate, wash basket and the second embodiment of the wash plate clothes deflector.

FIGS. 7 and 8 illustrate a second embodiment of the wash plate clothes deflector according to the invention. In the second embodiment, the wash plate is identical to the washplate illustrated in FIGS. 1 through 6. Therefore, like numerals will be used to identify like parts in the description of the second embodiment.

As best seen in FIG. 7, the wash plate clothes deflector 55' has a plurality of notches 72 circumferentially spaced about the clothes deflector 55' and extending from the periphery of the clothes deflector 55' toward the mid portion of the clothes deflector. The notches provide the clothes deflector with better flexibility and give the clothes deflector a scalloped periphery. It should be noted that clothes deflector 55' could also be made without the notches 72, if it is dual extruded and a diameter and or radius. Likewise, any of the other clothes deflectors disclosed in this application could also incorporate notches similar to those shown in FIG. 7.

As best seen in FIG. 8, the preferred construction of the clothes deflector 55' is a laminate comprising an elastic upper layer 74 and a low friction lower layer 76. The elastic layer has a thickness range of approximately 0.060 to 0.120 inches, with a preferred thickness of 0.080 inches. The low friction layer, 76 has thickness range of approximately 0.010 to 0.030 inches, with a preferred thickness of 0.020 inches. A suitable material for the elastic layer 74 is santoprene, or any other suitable material. The low friction layer 76 is preferably polypropylene or any other suitable material. The notches 72 extruded through both the elastic layer 74 and the low friction layer 76.

The clothes deflector 55' extends beyond the periphery of the wash plate 22 a sufficient distance so that the clothes deflector abuts the lower portion 38 of the wash basket 20. The clothes deflector 55' is also of sufficient length so that it is deflected upwardly with respect to the wash plate, resulting in the low friction surface 76 contacting the wash basket 20. Thus, in general, only the low friction layer 76 will abut the wash basket 22 and not the elastic layer 74, resulting in a very low level of noise being emitted by the movement of the wash plate 22 with respect to the wash basket 20. The notches 72 also prevent either layer of the clothes deflector 55' from puckering because of the deflection of the clothes deflector caused by its abutment with the wash basket 20. The tendency of the clothes deflector 55' to not pucker because of the notches 72 permits a better contact between the clothes deflector 55' and the wash basket 20 to better prevent clothes from being caught between the wash plate 22 and the wash basket 20.

Figure 9:
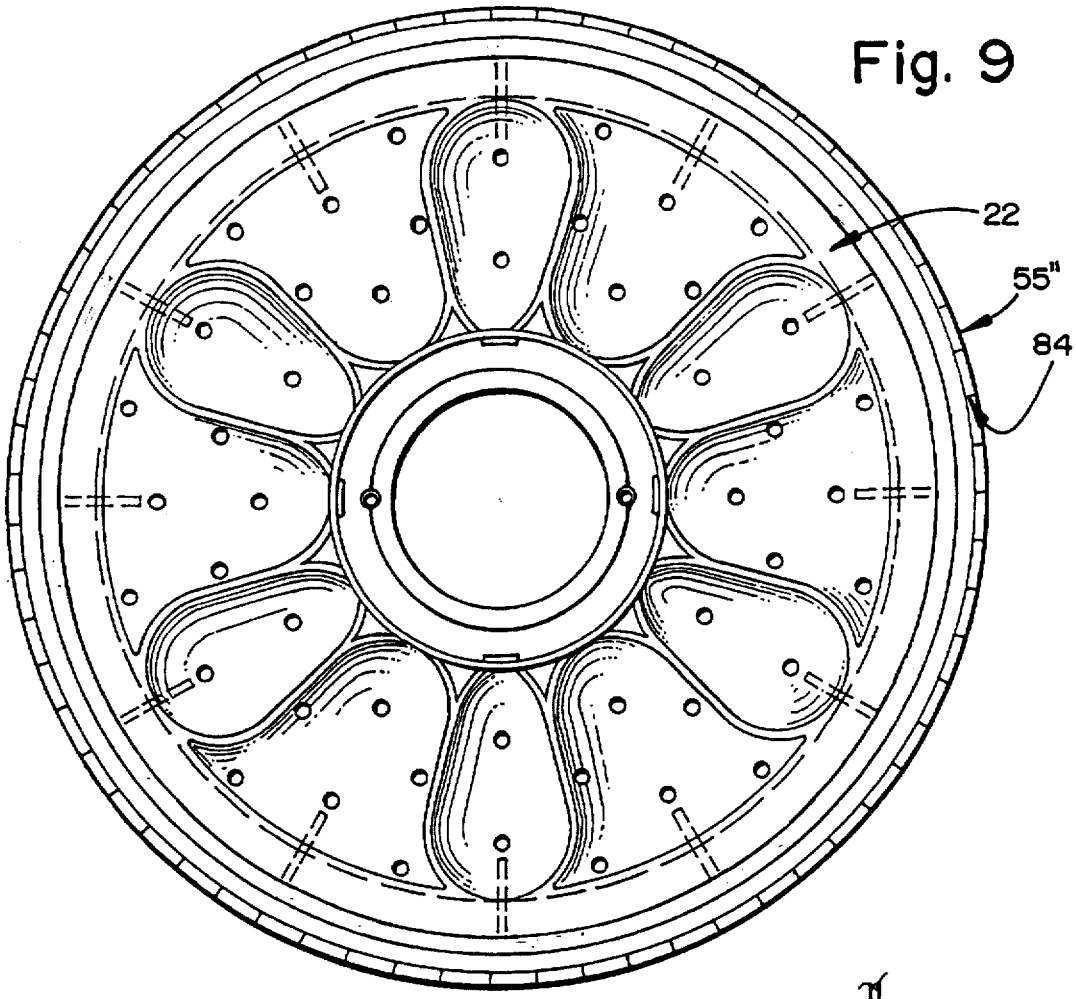
FIG. 9 is a plan view of the wash plate incorporating a third embodiment of the wash plate clothes deflector according to the invention.
Figure 10:
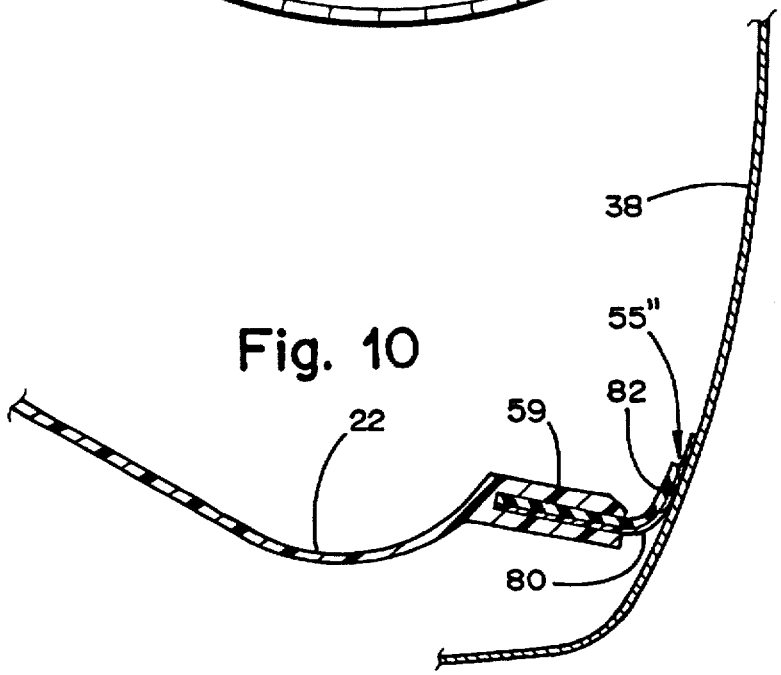
FIG. 10 is a sectional view similar to FIG. 6, illustrating the relationship between the wash plate, wash basket and the third embodiment of the wash plate clothes deflector.

FIGS. 9 and 10 illustrate a third embodiment of a wash plate clothes deflector according to the invention. The wash plate of the third embodiment is identical to the wash plate of the first two embodiments. Therefore, in the description of the third embodiments, like numerals will be used to identify like parts.

The wash plate clothes deflector 55' comprises an upper elastic layer 80 and a lower low friction layer 82, which is similar to the second embodiment. However, unlike the second embodiment, the upper elastic layer 80 is not laminated to the lower low friction layer 82. The elastic layer 80 and low friction layer 82 are free to move independently of each other. Also, the low friction layer 82 is of a greater width than the upper layer and extends beyond the terminal end of the elastic layer 80. Moreover, only the low friction layer, 82, has a plurality of notches 84 to prevent puckering of the low friction layer.

Preferably, the elastic layer 80 is made from ethylene propylene diene monomer (EPDM) having a thickness approximately between 0.060 to 0.120 inches and preferably 0.080 inches. The lower friction layer 82 is preferably made from polypropylene having an approximate thickness of 0.010 to 0.030 inches, with a preferred thickness of 0.020 inches.

As best seen in FIG. 10, when the wash plate is mounted within the wash basket 20, the elastic layer 80 and low friction layer 82 are both of sufficient length so that they are deflected upwardly along the inner surface of the wash basket 20. The low friction layer 82 is of sufficient length so that it extends beyond the terminal end of the elastic layer to prevent the elastic layer from contacting the inner surface of the wash basket.

Figure 11:
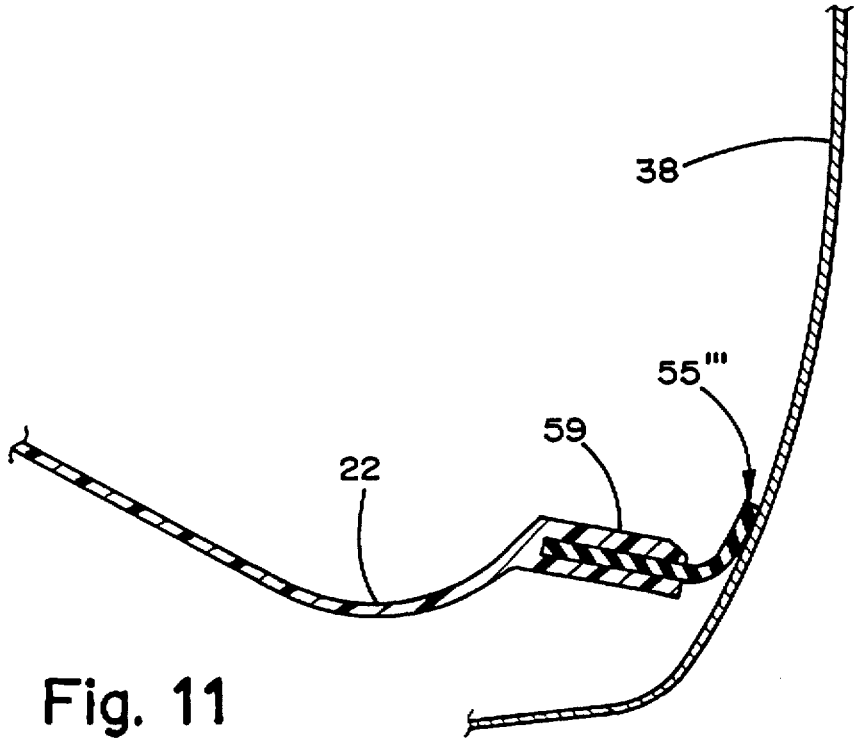
FIG. 11 is a sectional view similar to FIG. 6, but illustrating the relationship between the wash plate, wash basket, and a fourth embodiment of a wash plate clothes deflector.

FIG. 11 illustrates a fourth embodiment of the wash plate clothes deflector according to the invention. The structure of the wash plate for the fourth embodiment is very similar and can be identical to the second and third embodiments. Similarly, the wash plate clothes deflector 55''' of the fourth embodiment is very similar to the second and third embodiments except that the wash plate clothes deflector 55''' is a single layer having both elastic and low friction properties. Preferably, the single layer wash plate clothes deflector 55''' is extruded and made from santoprene.

Figure 12:
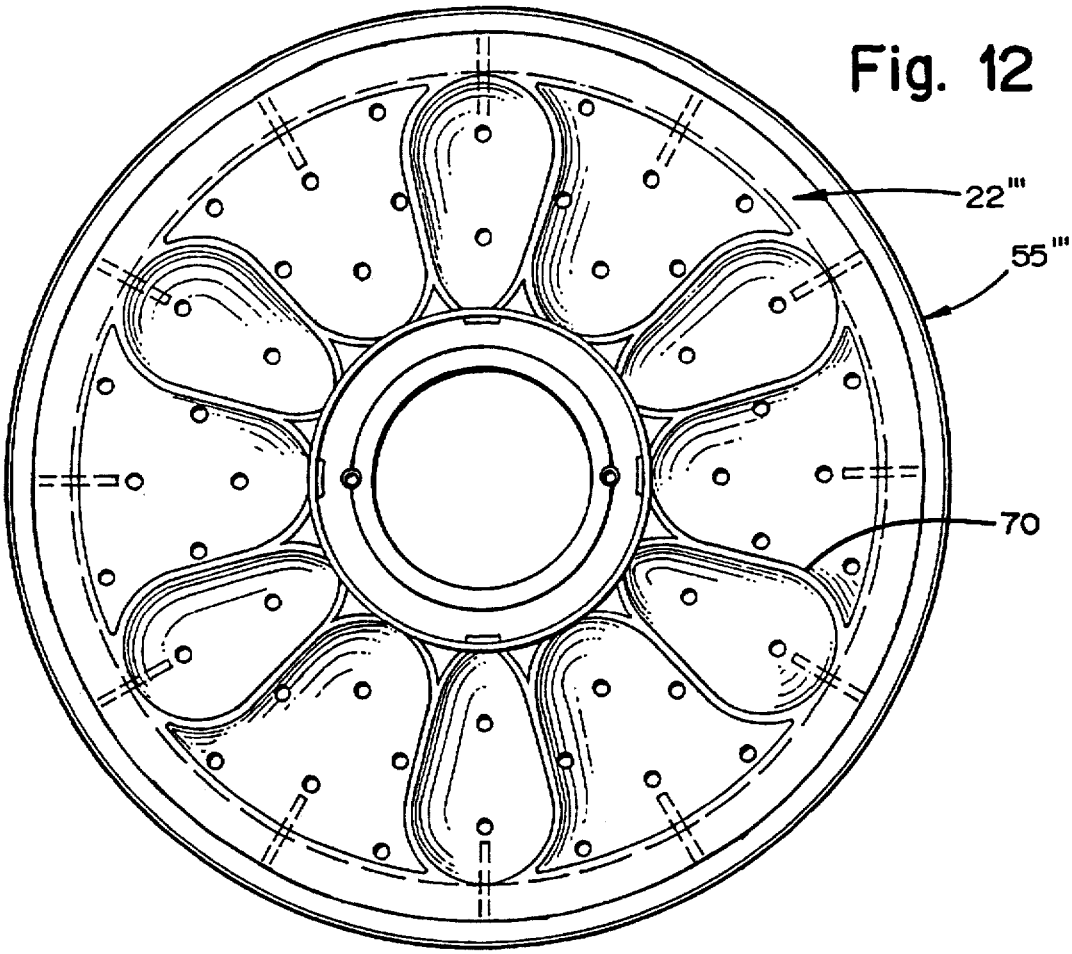
FIG. 12 is a plan view of the wash plate incorporating a fifth embodiment of the wash plate clothes deflector according to the invention.
Figure 13:
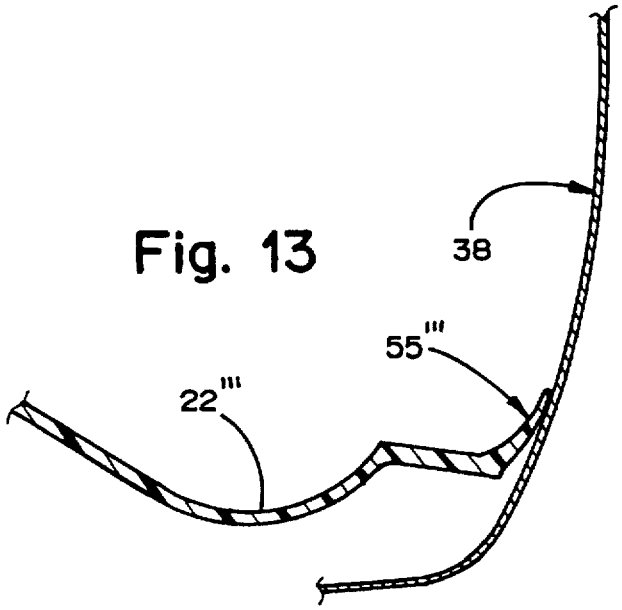
FIG. 13 is a sectional view similar to FIG. 6, but illustrating the relationship between the wash plate, wash basket, and wash plate clothes deflector of the fifth embodiment.

FIGS. 12 and 13 illustrate a fifth embodiment of the wash plate clothes deflector according to the invention. The fifth embodiment incorporates a wash plate 22'''' that is substantially identical to the previously described wash plate 22, except that the wash plate 22'''' no longer has a circumferential groove in which the wash plate clothes deflector is disposed. Rather, the wash plate 22'''' has in integrally formed wash plate clothes deflector 55''''. Preferably, the wash plate 22'''' and the wash plate clothes deflector 55'''' are manufactured from the same material, such as polypropylene. The wash plate clothes deflector has a preferred thickness of approximately 0.020 to 0.030 inches. As in the previous embodiments, the wash plate clothes deflector 5'''' is of a sufficient length so that it is deflected along the inner surface of the wash basket 20.

Figure 14:
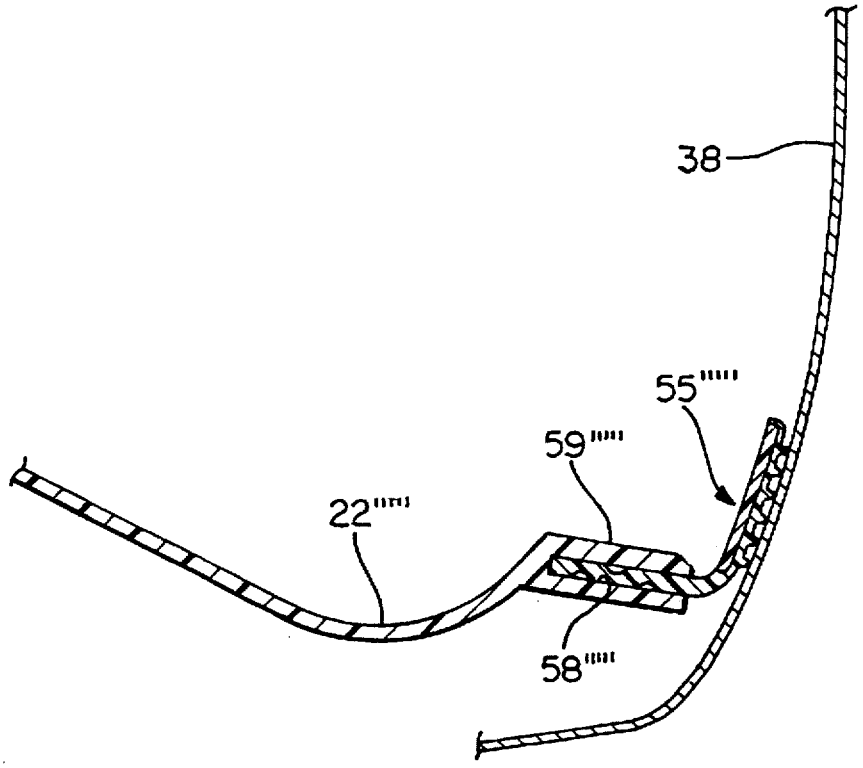
FIG. 14 is a sectional view similar to FIG. 6, but illustrating the relationship between the wash plate, wash basket, and washplate clothes deflector of the sixth embodiment.
Figure 15:
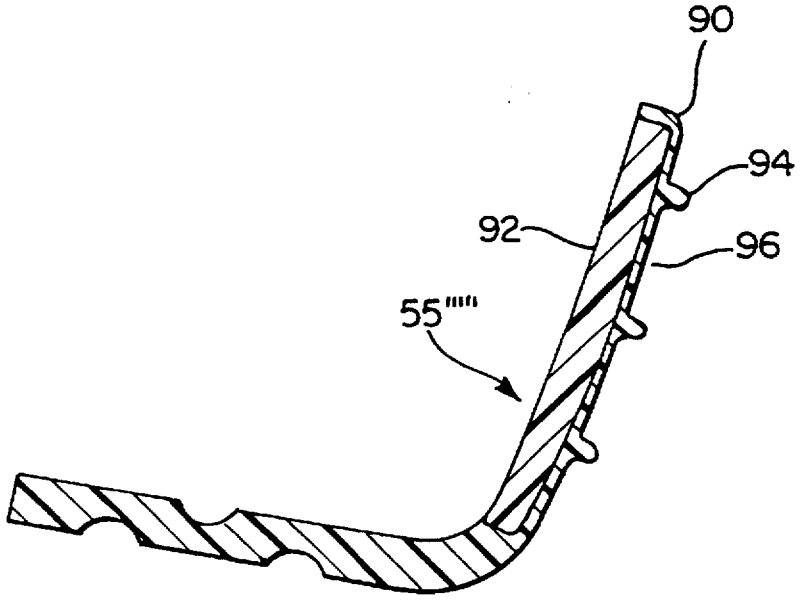
FIG. 15 is an enlarged view of FIG. 14 illustrating annular ribs of the washplate clothes deflector.

FIGS. 14 and 15 illustrate a sixth embodiment of the wash plate clothes deflector according to the invention. The sixth embodiment includes a washplate 22''''' that is similar to the washplate 22 and includes a peripheral lip 59''''' in which is formed a circumferential groove 58'''''. A washplate clothes deflector 55''''' is press-fit within the groove 58'''''. The washplate clothes deflector 55''''' is preferably dual extruded and comprises a friction layer 90, preferably made of polypropylene, and a elastic layer 92, preferably made of santoprene. Annular ribs 94 extend from the friction layer and define channels 96 between the adjacent ribs 94. The outer end of the friction layer 90 wraps around the outer end of the elastic layer 92 for protection, but it is not necessary to perform the invention.

The ribs 94 are extruded integrally with the friction layer 90. The ribs 94 extend twenty to thirty one-thousandths from the friction layer. However, the distance can vary depending on the application and the anticipated particle size. It is only necessary that the ribs extend a sufficient distance from the friction layer 90 to create channels 96 of sufficient depth that abrasive particles, such as sand, in the wash liquid can move freely in the channels 96 and not abrade the friction layer. The annular ribs 94 can have discrete breaks to provide an opening in the channels for the abrasive particles to wash out.

The washplate clothes deflector 55''''' is particularly suited for a washing environment where abrasive particles are common. During operation, the washplate clothes deflector 55''''' will move vertically and radially relative to the washbasket 38. As a result of this movement, abrasive particles in the wash liquid can work its way between the washplate clothes deflector 55''''' and the washbasket 38. These abrasive particles are then washed away through the channels 96 by the wash liquid. If not for the channels 96, the abrasive particles would remain trapped between the washplate clothes deflector 55''''' and the washbasket 38 where it would abrade the washplate clothes deflector 55''''' and the washbasket 38. This abrasion is particularly harmful to the washbasket, which is generally ceramic coated.

It should be noted that it is within the scope of the invention for all the wash plate clothes deflectors, except for the fourth embodiment, can be made as a single piece or as multiple pieces to aid in the assembly of the wash plate clothes deflector. It is also within the scope of the invention for all of the embodiments of the wash plate clothes deflector to have notches along its outer perimeter to prevent the wash plate clothes deflector from puckering as it is deflected by it abutment with the wash basket. The prevention of the puckering of the wash plate clothes deflector material permits the wash plate clothes deflector to form a continuous seal along the interior of the wash basket to prevent clothing in the treatment zone 27 from being trapped or caught between the wash plate and the wash basket, which may damage the clothing.

The wash plate clothes deflector according to the invention provides a cost effective and easy to assemble solution to eliminating the gap between the wash plate and the wash basket by using alone or in combination spring force or elastic force to cause the clothes deflector to abut the wash basket.

We claim:

1. An automatic washer for washing clothing, the automatic washer comprising:

a wash basket having a perimeter wall;

a washplate disposed adjacent the wash basket;

a deflector provided on the washplate and abutting the perimeter wall; and the deflector comprising a biasing portion and a low friction portion and the biasing portion biases the deflector into abutting relationship with the wash basket and the low friction portion decreases the friction between the deflector and the wash basket.

2. An automatic washer according to claim 1, wherein the deflector further comprises an elastic layer as the biasing portion and a low friction layer as the low friction portion.

3. An automatic washer according to claim 2, wherein the deflector is a composite formed of the elastic layer and the low friction layer.

4. An automatic washer according to claim 3, wherein the low friction layer extends beyond a peripheral edge of the elastic layer to prevent the elastic layer from directly abutting the wash basket.

5. An automatic washer according to claim 2, wherein the low friction layer extends beyond a peripheral edge of the elastic layer to prevent the elastic layer from directly abutting the wash basket.

6. An automatic washer according to claim 2, wherein the elastic layer is an elastomer selected from the group of santoprene, EPDM or rubber.

7. An automatic washer according to claim 6, wherein the low friction layer is polypropylene.

8. An automatic washer according to claim 7, wherein the thickness of the elastic layer is in the range of approximately 0.060 to 0.120 inches, and the thickness of the low friction layer is in the range of approximately 0.010 to 0.030 inches.

9. An automatic washer according to claim 8, wherein the thickness of the elastic layer is approximately 0.080 inches and the thickness of the low friction layer is approximately 0.020 inches.

10. An automatic washer according to claim 1, wherein the deflector is integrally formed with the washplate.

11. An automatic washer according to claim 1, wherein the deflector further comprises spring fingers formed in the deflector as the biasing portion.

12. An automatic washer according to claim 11, wherein the deflector further comprises an elastic layer and a low friction layer, the biasing portion being the combination of the spring finger and the elastic layer and the low friction layer being the low friction portion.

13. An automatic washer according to claim 12, wherein the washplate has a peripheral edge with a groove in which the spring fingers of the deflector are mounted.

14. An automatic washer according to claim 1, wherein the deflector has a plurality of notches about its periphery to reduce the puckering of the deflector when it is in abutting relationship with the wash basket.

15. An automatic washer according to claim 14, wherein the deflector further comprises an elastic layer as the biasing portion and a low friction layer as the low friction portion and one of the elastic layer and the low friction layer has a plurality of notches about its periphery to reduce the puckering of the deflector when it is in abutting relationship with the wash basket.

16. An automatic washer according to claim 15, wherein the other of the elastic layer and the low friction layer has a plurality of notches about its periphery to reduce the puckering of the deflector when it is in abutting relationship with the wash basket.

17. An automatic washer according to claim 1, wherein the wash basket is cylindrical, the washplate is received within the perimeter wall, the deflector abuts an inner surface of the perimeter wall and a clothing treatment area is defined by the perimeter wall, washplate and deflector.

18. An automatic washer according to claim 1, wherein at least one pair annular ribs extend from the low friction portion and define a channel between the pair of ribs.

19. An automatic washer according to claim 18, wherein the pair of annular ribs extend from the low friction portion a sufficient distance to permit an abrasive particle to move in the channel.

20. An automatic washer according to claim 19, wherein the annular ribs have a least one gap to provide an opening through which an abrasive particle can move.

21. An automatic washer according to claim 19, wherein the low friction portion is a layer of polypropylene and the biasing portion is a layer of santoprene.

22. An automatic washer according to claim 21, wherein the polyproplyene and santoprene layers are dual extruded.

23. An automatic washer for washing clothing, the automatic washer comprising:

a wash basket having a perimeter wall defining an access opening;

a washplate disposed adjacent the wash basket;

a deflector provided on the washplate and abutting the perimeter wall; and the deflector comprising an elastic layer and a low friction layer and the elastic layer biases the low friction layer into abutting relationship with the perimeter wall.

24. An automatic washer according to claim 23, wherein the deflector has spring fingers to bias the deflector toward the wash basket.

25. An automatic washer according to claim 23, wherein the deflector is a composite formed of the elastic layer and the low friction layer.

26. An automatic washer according to claim 25, wherein the low friction layer extends beyond a peripheral edge of the elastic layer to prevent the elastic layer from directly abutting the wash basket.

27. An automatic washer according to claim 23, wherein the low friction layer extends beyond a peripheral edge of the elastic layer to prevent the elastic layer from directly abutting the wash basket.

28. An automatic washer according to claim 23, wherein the elastic layer is an elastomer selected from the group of santoprene, EPDM or rubber.

29. An automatic washer according to claim 28, wherein the low friction layer is polypropylene.

30. An automatic washer according to claim 29, wherein the thickness of the elastic layer is in the range of approximately 0.060 to 0.120 inches, and the thickness of the low friction layer is in the range of approximately 0.010 to 0.030 inches.

31. An automatic washer according to claim 30, wherein the thickness of the elastic layer is approximately 0.080 inches and the thickness of the low friction layer is approximately 0.020 inches.

32. An automatic washer according to claim 23, wherein one of the elastic layer and the low friction layer has a plurality of notches about its periphery to reduce the puckering of the deflector when it is in abutting relationship with the wash basket.

33. An automatic washer according to claim 32, wherein the other of the elastic layer and the low friction layer has a plurality of notches about its periphery to reduce the puckering of the deflector when it is in abutting relationship with the wash basket.

34. An automatic washer for washing clothing, the automatic washer comprising:

a wash basket having a perimeter wall defining an access opening;

a washplate disposed adjacent the wash basket;

a deflector provided on the washplate and abutting the perimeter wall; and springs disposed between the washplate and deflector to bias the deflector toward the wash basket.

35. An automatic washer according to claim 34, wherein the springs are spring fingers formed in the deflector.

36. An automatic washer according to claim 35, wherein the deflector comprises an elastic layer and a low friction layer.

37. An automatic washer according to claim 36, wherein the low friction layer extends beyond a peripheral edge of the elastic layer to prevent the elastic layer from directly abutting the wash basket.

38. An automatic washer according to claim 37, wherein the deflector has a plurality of notches about its periphery to reduce the puckering of the deflector when it is in abutting relationship with the wash basket.

39. An automatic washer for washing clothing, the automatic washer comprising:

a wash basket having a perimeter wall defining an access opening;

a washplate disposed adjacent the wash basket;

a deflector provided on the washplate and abutting the perimeter wall; and the deflector has a plurality of notches about its periphery to reduce the puckering of the deflector when it is in abutting relationship with the wash basket.

* * * * *